US007277847B2

(12) United States Patent
Berger

(10) Patent No.: US 7,277,847 B2
(45) Date of Patent: Oct. 2, 2007

(54) METHOD FOR DETERMINING INTENSITY PARAMETERS OF BACKGROUND NOISE IN SPEECH PAUSES OF VOICE SIGNALS

(75) Inventor: Jens Berger, Berlin (DE)

(73) Assignee: Deutsche Telekom AG, Bonn (DE)

( * ) Notice: Subject to any disclaimer, the term of this patent is extended or adjusted under 35 U.S.C. 154(b) by 894 days.

(21) Appl. No.: 10/311,487

(22) PCT Filed: Apr. 3, 2002

(86) PCT No.: PCT/DE02/01200

§ 371 (c)(1),
(2), (4) Date: Dec. 17, 2002

(87) PCT Pub. No.: WO02/084644

PCT Pub. Date: Oct. 24, 2002

(65) Prior Publication Data

US 2003/0191633 A1 Oct. 9, 2003

(51) Int. Cl.
*G10L 11/02* (2006.01)
*G10L 21/00* (2006.01)

(52) U.S. Cl. ..... 704/211; 704/228; 704/233; 704/205

(58) Field of Classification Search ..... 704/205
See application file for complete search history.

(56) References Cited

U.S. PATENT DOCUMENTS

| | | | | |
|---|---|---|---|---|
| 4,481,593 | A | 11/1984 | Bahler | 364/513.5 |
| 4,811,404 | A | 3/1989 | Vilmur et al. | 381/94 |
| 5,598,466 | A | 1/1997 | Graumann | 379/389 |
| 6,031,915 | A | 2/2000 | Okano et al. | 381/56 |
| 6,044,342 | A | 3/2000 | Sato et al. | 704/233 |
| 2003/0156633 | A1* | 8/2003 | Rix et al. | 375/225 |

FOREIGN PATENT DOCUMENTS

| | | |
|---|---|---|
| DE | 3236834 | 11/1984 |
| DE | 69313480 | 8/1993 |
| DE | 19629184 | 2/2000 |

(Continued)

OTHER PUBLICATIONS

John G. Beerends et al., "A Perceptual Speech-Quality Measure Based on a Psychoacoustic Sound Representation", J. Audio Eng. Soc., vol. 42, No. 3, Mar. 1994, pp. 115-123.

(Continued)

*Primary Examiner*—V. Paul Harper
(74) *Attorney, Agent, or Firm*—Darby & Darby

(57) ABSTRACT

A method for determining intensity characteristics of background noise during speech pauses of speech signals includes determining a proportion of speech pauses in the undisturbed source speech signal so as to define a frequency threshold. The disturbed speech signal is divided into short successive signal elements, an intensity value is determined for each of the signal elements, and a cumulative relative frequency distribution is formed from the determined intensity values of the signal elements. The cumulative relative frequency distribution is used to determine an intensity threshold value which corresponds to the defined frequency threshold. At least one intensity characteristic of the background noise during the speech pauses is determined using a region of the cumulative relative frequency distribution below the intensity threshold value.

9 Claims, 5 Drawing Sheets

Relative Frequency Distribution of the Short-Time Intensities of the Disturbed Speech Signal

FOREIGN PATENT DOCUMENTS

| | | |
|---|---|---|
| EP | 0556992 | 8/1993 |
| WO | 0052683 | 9/2000 |
| WO | 0070604 | 11/2000 |

OTHER PUBLICATIONS

Shihua Wang et al., "Auditory Distortion Measure for Speech Coding", IEEE, 1991, pp. 493-496.

International Telecommuication Union, "Objective quality measurement of telephone-band speech codes", ITU-T Recommendation, p. 861 Geneva Feb. 1998, 41 pages (cover + 2 pages, pp. ii-v, pp. 1-34).

European Telecommunication Standard, "European digital cellular telecommunications system (Phase 2); Voice Activity Detection (VAD)", (GSM 06.32), European Telecommunications Standards Institute Recommendation, Valbonne, Sep. 1994, pp. 1-36.

* cited by examiner

METHOD FOR DETERMINING INTENSITY PARAMETERS OF BACKGROUND NOISE IN SPEECH PAUSES OF VOICE SIGNALS

CROSS REFERENCE TO RELATED APPLICATIONS

This application is a U.S. National Stage Application under 35 U.S.C. § 371 of PCT International Application No. PCT/DE02/01200, filed Apr. 3, 2002, which claims priority to German Patent Application No. 101 20 168.0, filed Apr. 18, 2001. Each of these applications is hereby incorporated by reference as if set forth in its entirety.

BACKGROUND

The present invention relates to a method for assessing background noise during speech pauses of recorded or transmitted speech signals.

The perceived speech quality, for example, in telephone connections or radio transmissions, is chiefly determined by speech-simultaneous interference, that is, by interference during speech activity. However, noise during the speech pauses goes into the quality decision as well, in particular in the case of high-quality speech reproduction.

The intensity of the background noise during the speech pauses can be used as a supplementary characteristic for determining the speech quality.

Speech quality evaluations of speech signals are generally carried out by listening ("subjective") tests with test subjects.

On the other hand, the goal of instrumental ("objective") methods for determining speech quality is to determine characteristics which describe the speech quality of the speech signal from properties of the speech signal to be assessed, using suitable calculation methods without having to draw on the judgements of test subjects.

A reliable quality assessment is provided by instrumental methods which are based on a comparison of the undisturbed reference speech signal (source speech signal) and the disturbed speech signal at the end of the transmission chain. There are many such methods, which are mostly employed in so-called "test connection systems". In this context, the undisturbed source speech signal is injected at the source and recorded after transmission.

Known methods for determining the intensity of background noise usually start from the disturbed signal itself and use a determined intensity threshold to distinguish active speech and speech pauses (FIG. 1). In the simplest case, this threshold is set to be constant in the method, but can also be adapted on the basis of the signal pattern (for example, a defined distance from the signal peak value). The goal is a reliable distinction between speech and speech pause. If the distinction is achieved, the sought intensity characteristics of the background noise can be determined from the signal segments that have been identified as a speech pause. To this end, the signal segments that have been identified as a speech pause are generally further divided into shorter segments (typically 8 . . . 40 ms) and the intensity calculations (for example, effective value or loudness) are carried out for these shorter segments. Then, intensity characteristics can be determined from the results.

Given low noise intensities during speech pauses and, at the same time, high speech intensity (high speech-to-noise ratio), these methods yield reliable measured values because a reliable distinction can be made between speech and speech pause (FIG. 1).

In the case of increasing noise intensities during speech pauses (decreasing speech-to-noise ratio), increasingly uncertainties arise in the distinction between speech and speech pauses. Here, it is difficult to fix the threshold value in such a manner that, on one hand, no noise segments with higher intensities than speech are detected (threshold too low) and, on the other hand, no speech segments of lower intensity are judged as a speech pause (threshold too high) (FIG. 2).

If the intensity of the noise during the speech pauses reaches or even exceeds the intensity of the active speech, no intensity threshold can be found that would permit a distinction between speech and speech pause.

Solutions to the described problems are possible if, for example, speech and background noise have different spectral characteristics. By appropriately prefiltering the signal or via spectral analysis and evaluation of selected frequency bands, it is possible here to achieve a higher speech-to-background noise ratio in the observed frequency bands, making a reliable distinction between speech and speech pause possible again.

Other solutions make use of certain parameters, which are determined in speech coding, and use them to distinguish between speech and segments containing background noise. In this context, the goal is to derive from the parameters whether the observed signal segment has typical properties of speech (for example, voiced portions). An example of this is the "Voice-Activity Detector" (ETSI Recommendation GSM 06.92, Valboune, 1989).

In the case of low speech-to-noise ratios, these methods work more ruggedly and are primarily used to suppress the transmission of speech pauses, for example, in mobile radio communications. However, the methods show uncertainties when the background noise itself contains speech or is similar to speech. Such segments are then classified as speech although they are perceived by a listener as disturbing background noise.

Instrumental speech quality measurement methods are usually based on the principle of signal comparison of the undisturbed reference speech signal and the disturbed signal to be assessed. Examples of this include the publications:

"A perceptual speech-quality measure based on a psychacoustic sound representation" (Beerends. J. G.: Stemerdink, J. A., J. Audio Eng. Soc. 42 (1994) 3, p. 115-123).

"Auditory distortion measure for speech coding" (Wang, S; Sekey, A.; Gersho, A.: IEEE Proc. Int. Conf. acoust., speech and signal processing (1991), p. 493-496).

Such a method is also described in the ITU-T standard P.861 currently in force: "Objective quality measurement of telephone-band speech codecs" (ITU-T Rec. P.861, Geneva 1996).

Such measurement methods are employed in so-called "test connection systems", in which a knot, reference speech signal (source speech signal) is injected at the source, transmitted, for example, via a telephone connection, and recorded at the sink. Subsequent to recording the speech signal, its properties are compared to those of the undisturbed source speech signal to assess the speech quality of the possibly disturbed speech signal.

If the undisturbed source speech signal is available to determine the background noise during speech pauses, then this signal can be used to determine the transition moments from speech to speech pause or from speech pause to speech, respectively. To this end, for example, a method with threshold value determination, as described above, is applied to the source speech signal. The method provides reliable distinctions between speech and speech pause because the speech-to-noise ratio in the undisturbed source speech signal is sufficiently high (FIG. 3*a*). The moments of threshold passage, that is, beginning and end of speech activity can now be transferred to the disturbed speech signal (FIG. 3*b*).

Such a method can be modified without problems if a constant time lag (for example, a delay due to signal transmission) occurs between the source speech signal and the disturbed signal. However, the condition is that this time lag can be reliably determined in advance and that it is then used to correct the end or beginning points of speech activity. This is mostly possible in the case of time-invariant systems because these have a constant delay (FIG. 3*c*)

In principle such a method works also if the time offset between the two signals is not constant for the entire signal length but is variable. These time-invariant systems include, in particular, packet-based transmission systems where marked fluctuations in the system delay can occur due to different packet transit times and a corresponding starting points management in the receiver. To prevent losses due to packets that arrive late, sometimes speech pauses are extended and later ones are shortened in the receiver. Starting or end points of speech activity can then only be transmitted if the current delay at these points is known. The adaptive determination of the time offset is computing-time intensive and frequently only inadequately achieved, especially in the case of reduced speech-to-noise ratios. If the adaptive determination of the time offset is not achieved reliably then the beginning and the end of speech pauses cannot be determined exactly or not at all. Because of this, the intensity characteristics of noise during pauses cannot or only unreliably be determined.

As described, it is difficult or sometimes impossible to determine background noise during speech pauses even if the undisturbed source speech signal is known, especially when

- a low speech-to-background noise ratio exists,
- the background noise contains speech or is similar to speech itself,
- the time offset between the undisturbed source speech signal and the disturbed speech signal is not constant over the entire signal length.

The known methods are based on determining the starting and end points of a speech pause as accurately as possible. As a result, the signal of the pause segments is then available for further evaluation. The intensity characteristics are determined from these separated pause segments.

SUMMARY OF THE INVENTION

An object of the present invention is to provide a method which provides reliable and rapid determination of intensity characteristics of the background noise during speech pauses even under the conditions noted above when both the source speech signal and the disturbed speech signal are available recorded.

Using the present method, intensity characteristics of background noise during speech pauses can be determined without having to determine the exact starting or end points of a pause segment. Moreover, it is not necessary to separate the speech pause signal for the evaluation.

The method for determining intensity characteristics of background noise during speech pauses of speech signals here described is based on the cumulative frequency distribution of the intensity values of the signal segments into which the speech signal is previously divided. These short-time signal intensities refer to signal segments having a duration of, for example. 8 ms or 16 ms. The frequency distribution indicates the magnitude of the fraction of short-time intensities below a defined threshold value.

To calculate the frequency distribution, the speech signal to be analyzed is divided into short successive signal segments and the intensity value (for example, loudness or effective value) is determined for each signal segment.

BRIEF DESCRIPTION OF THE DRAWINGS

In the following, the present invention will be explained in greater detail based on exemplary embodiments with reference to the drawings, in which.

DETAILED DESCRIPTION

Figure 4:
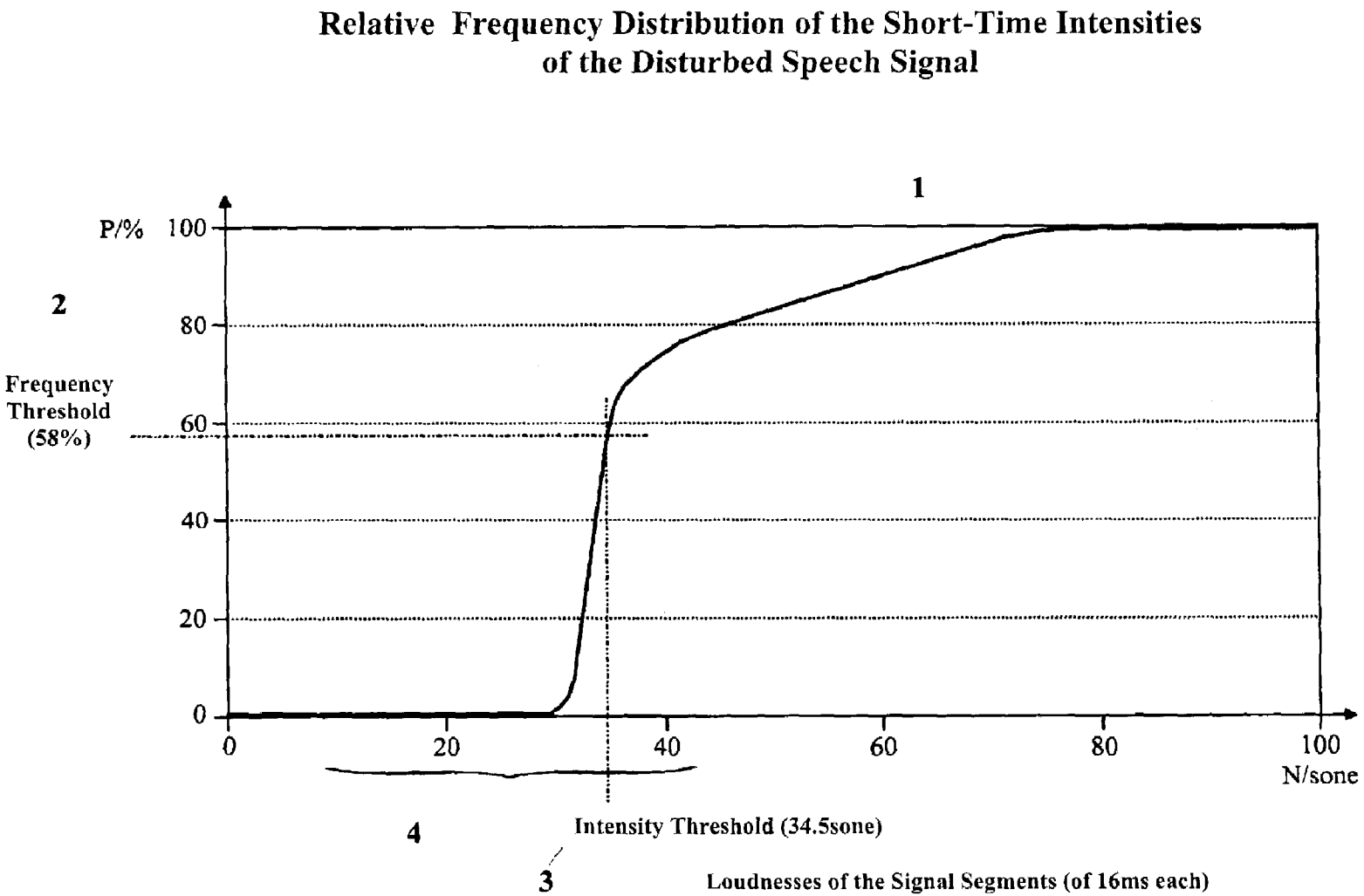
FIG. 4 shows a relative frequency distribution of the short-time intensities of a disturbed speech signal for a speech signal containing stationary background noise.

FIG. 4 shows a typical curve shape for speech signals containing stationary background noise (speech-to-noise ratio: approximately 10 dB). The cumulative frequency distribution is depicted by the example of short-time loudnesses (loudnesses calculated in accordance with ISO532). 2000 segments having a length of 16 ms were evaluated. It can be seen that none of the segments has a lower value than 30 sone (P=0%) and none of the segments reaches a higher value than 80 sone either since here the value P=100% is already reached. The steep rise of the function at about 30 sone suggests a low fluctuation of the signal intensity over large ranges (almost 70%) of the signal. The signal used here was a speech signal with additive white noise.

Figure 1:
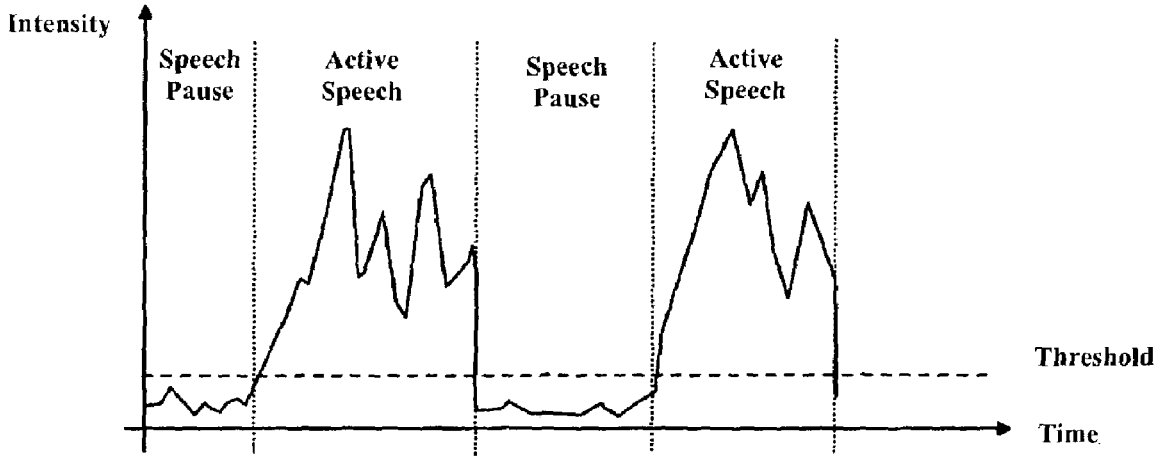
Fig. 1 PRIOR ART
FIG. 1 shows a graph of intensity versus time for a disturbed speech signal with a determined intensity threshold for distinguishing active speech and speech pauses according to a prior art method for determining the intensity of background noise.
Figure 2:
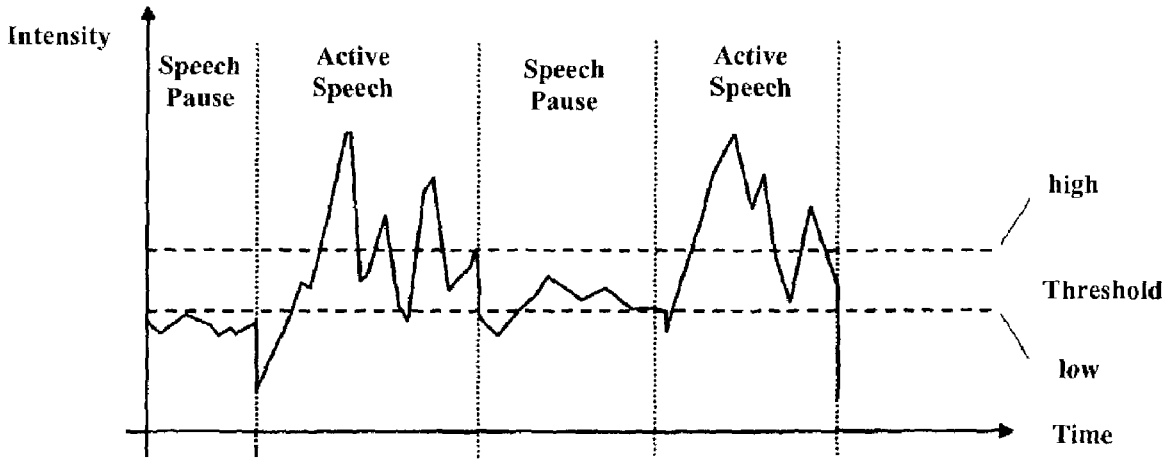
Fig. 2 PRIOR ART
FIG. 2 shows a graph of intensity versus time for a disturbed speech signal with a high and a low intensity threshold for distinguishing active speech and speech pauses according to a prior art method for determining the intensity of background noise.
Figure 3:
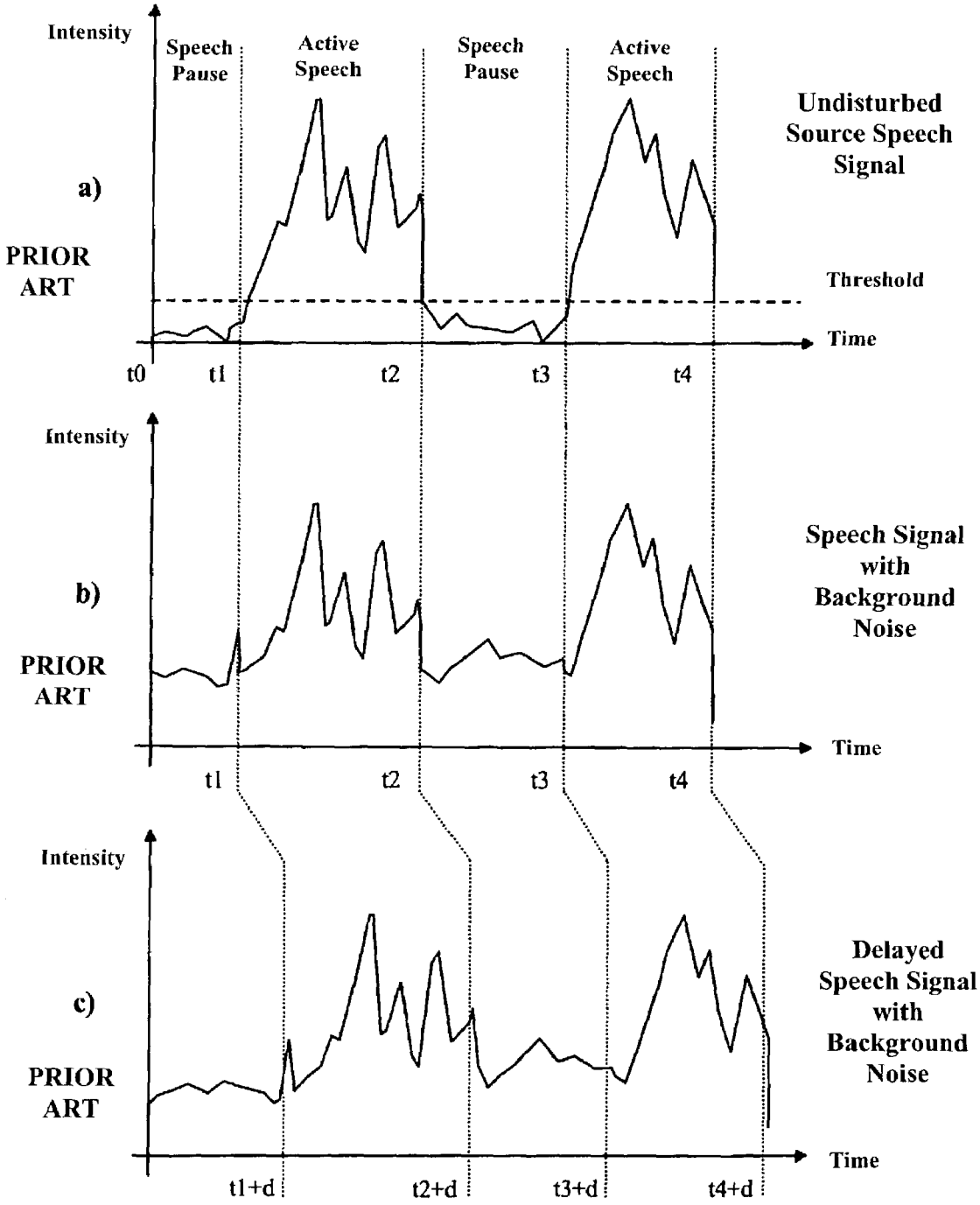
FIG. 3*a* shows a graph of intensity versus time for an undisturbed source speech signal with a determined intensity threshold for distinguishing active speech and speech pauses in a test connection system according to a prior art method for determining the intensity of background noise.
FIG. 3*b* shows a graph of intensity versus time for the speech signal of FIG. 3*a* with background noise showing the beginning and end of speech activity.
FIG. 3*c* shows a graph of intensity versus time for the speech signal of FIG. 3*a* with background noise showing the beginning and end of speech activity and a constant time lag between the source speech signal and the disturbed signal.

Such a distribution function is now intended to be used to determine intensity characteristics of background noise during the speech pauses. To this end, it is necessary to know the proportion of speech pauses in the overall signal. This proportion can be determined from the undisturbed source speech signal (FIG. 3*a*).

Total length of the speech pauses=$(t1-t0)+(t3-t2)$

Total length of the signal segment=$(t4-t0)$ $$\text{Proportion of speech pauses} = \frac{\text{total length of the speech pauses}}{\text{total length of the signal segment}}$$

When assuming that the ratio of active speech to speech pauses remains substantially constant during the transmission, this value can also be applied to the disturbed signal.

If the proportion of speech pauses of the overall speech signal is known and if this proportion is defined as the frequency threshold, then the intensity threshold value which corresponds to the frequency threshold can be determined from the frequency distribution of the short-time intensities.

In FIG. 4, a proportion of speech pauses of 58% is plotted as an example. This frequency threshold $P_z$=0.58 corresponds to an intensity threshold value of N=34.5 sone, which means that 58% of the signal segments do not exceed the intensity value (loudness) of 34.5 sone.

The region below the intensity threshold value shows the frequency distribution for intensity values of signal segments during the speech pauses and can be used to determine intensity characteristics of the background noise during the speech pauses.

It is assumed that no speech pause segment has a higher intensity value than a speech segment so that the intensity threshold value can be regarded as the maximum value for the background noise during speech pauses.

Determination of the Arithmetic Mean of Intensities

The arithmetic mean of all segments whose intensities are below a previously determined frequency threshold can also be derived from the cumulative distribution function. To this end, initially, the cumulative distribution function P(x) has to be differentiated to a distribution density function p(x).

The arithmetic mean of all evaluated intensities X of the overall signal is calculated in known manner from the integral of the distribution density function p(x):

$$\overline{X} = \int_{-\infty}^{\infty} x\,p(x)dx$$

By limiting the integration at a certain value $x_G$, it becomes possible to determine the arithmetic mean over all values X below this limiting value. In this context, however, the result has to be weighted with frequency $P(x_G)$. This frequency corresponds to the integral over p(x) up to value $x_G$.

Figure 5:
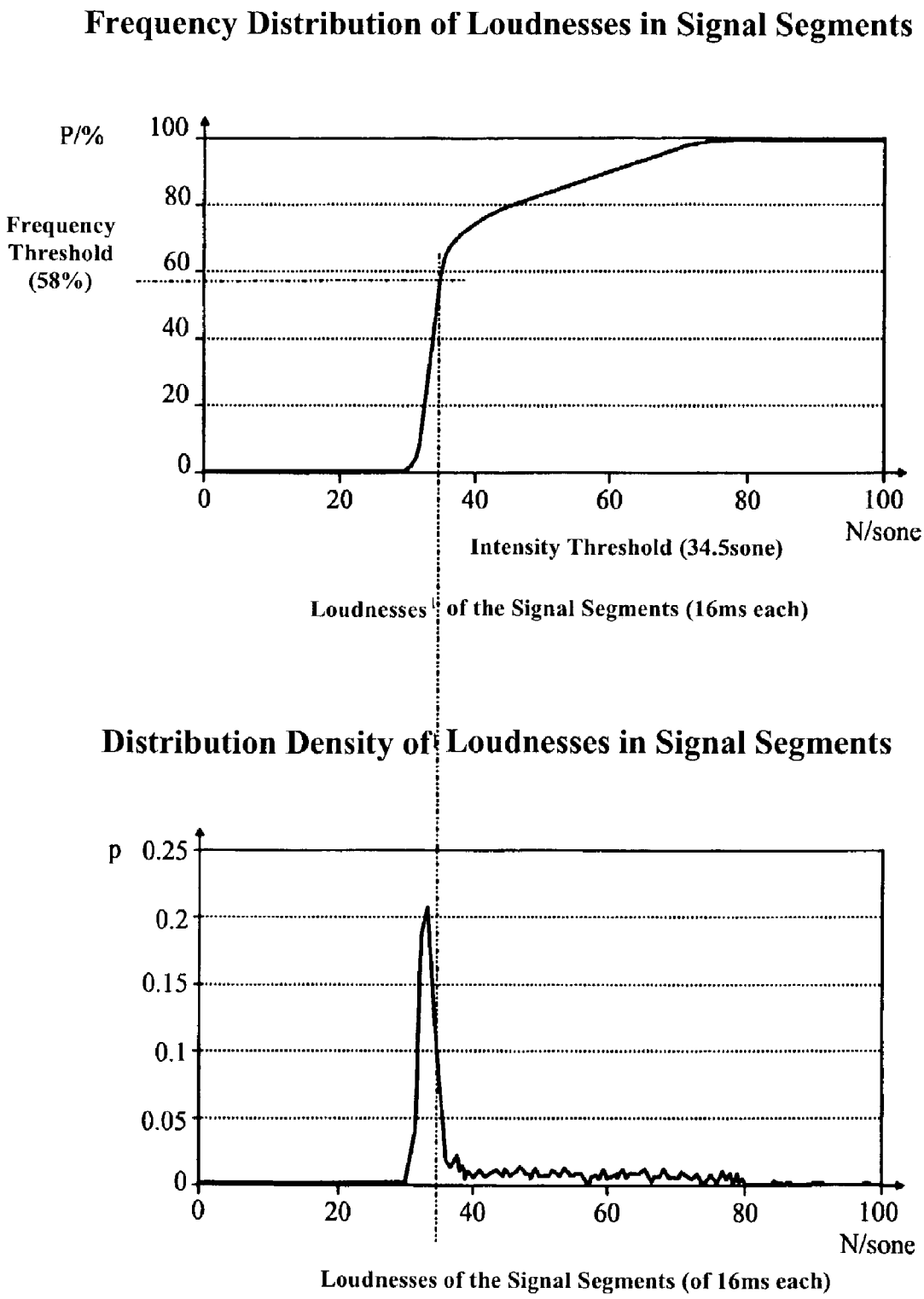
FIG. 5 shows the relative frequency distribution of FIG. 4 and a corresponding graph of the frequency distribution of loudnesses in signal segments.

Intensity threshold value $x_G$ can be derived from distribution function P(x). In the example according to FIG. 4, frequency threshold value $P(x_G)$ is the proportion of speech pauses in overall signal $P_z$=0.58 with which is associated the intensity threshold value $x_G$=34.5 sone. The arithmetic mean of all segments having ant intensity which is smaller than $x_G$ is calculated according to equation 2, where $x_G$=34.5 sone. Here, the frequency of 58% corresponds to the weighting value $P(x_G=34.5)$=0.58. This procedure is graphically shown in FIG. 5.

$$\overline{X} = \int_{-\infty}^{x_G} x\,p(x)dx \Big/ \int_{-\infty}^{x_G} p(x)dx = \int_{-\infty}^{x_G} x\,p(x)dx / P(x_G)$$

If now, again, it is assumed that the intensities of segments during speech pauses do not exceed the intensities of speech segments or that the background noise has only weak temporal fluctuations, the calculated arithmetic mean can be regarded as the mean of the intensities during speech pauses.

Simplified Method for Determining the Arithmetic Mean

A simplified method for determining the mean over all X starts from the assumption that the relative frequency distribution of the intensity values of the signal segments in the region p(x)=0 up to the frequency threshold value of speech pauses $P_z$ can be approximated by a weighted normal distribution $G(x, \mu, \sigma^2)$. The value for the distribution function $G(x, \mu, \sigma^2)$ for $x \rightarrow \infty$ is 1. As is known, value x for which $G(x, \mu, \sigma^2)$=0.5 corresponds to the arithmetic mean over all individual values X.

If an approximation of relative frequency distribution P(x) in the region of P(x)=0 to $P_z$ is achieved with a weighted normal distribution $\kappa P_z\, G(x, \mu, \sigma^2)$, then the arithmetic mean over X for the weighted normal distribution corresponds to value x for which $G(x, \mu, \sigma^2)=0.5\ \kappa P_z$. Due to the assumption that $\kappa P_z\, G(x, \mu, \sigma^2)$ approximates distribution P(x) in the region of P(x)=0 to $P_z$ to a good degree and $\kappa \geqq 1$, the arithmetic mean sought corresponds to value $x_A$ for which $P(x_A)=0.5\ \kappa P_z$.

Figure 6:
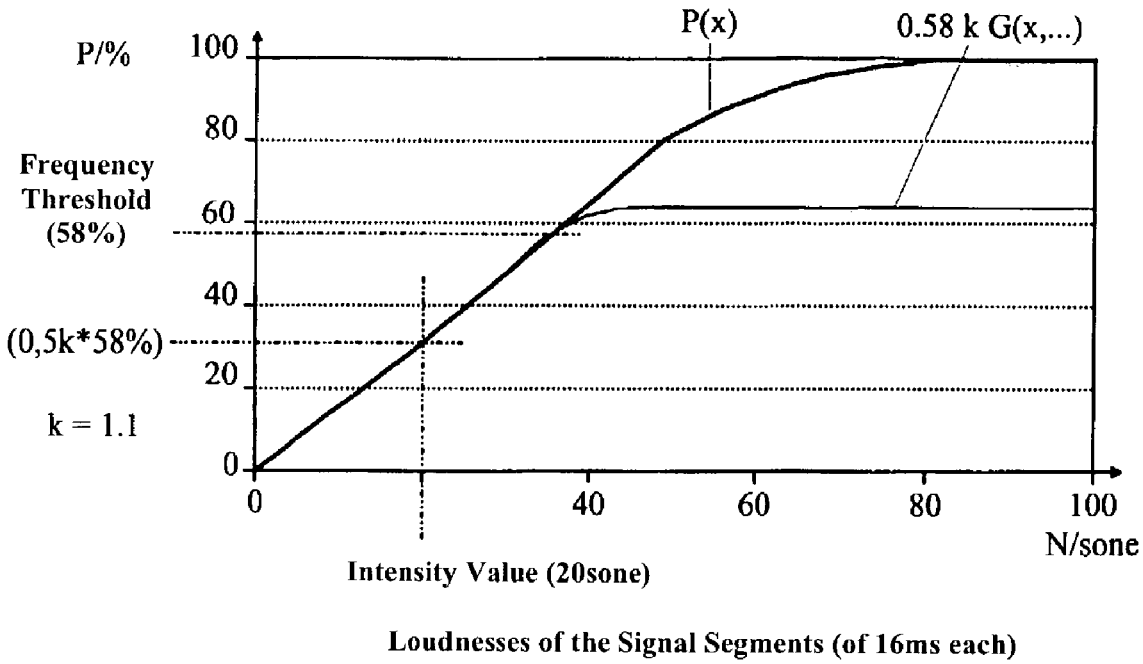
FIG. 6 shows a weighted normal relative frequency distribution demonstrating a simplified method for calculating an arithmetic mean of short-time speech segment intensities.

For the application case of speech with additive background noise observed here, values for κ=1 . . . 1.3 show good approximation results. An example of the approximation through weighted normal distributions is shown in FIG. 6. In this context, a value κ=1.1 was selected. The diagram shows speech as background nose and features a proportion of speech pauses of 58%. The strong temporal fluctuation of the speech background can be clearly seen as a flat gradient in the region N=0 . . . 40 sone. The arithmetic mean derived from the normal distribution function with $P(x_A)=0.5\ \kappa P_z$=0.32 is 20 sone.

The advantage of this simplified method is the smaller computing intensity because the calculation of the distribution density and the integration thereof can be dispensed with. Likewise, it is not necessary to accurately determine the normal distribution function $\kappa P_z\, G(x, \mu, \sigma^2)$, it is already sufficient to define κ. Since $P_z$ is known, the mean is determined over all $X<x_G$ as a value $x_A$ for which $P(x_A)=0.5\ \kappa P_z$. Thus, the arithmetic mean over all X up to $x_G$ corresponds to the intensity value that corresponds to a frequency value of 0.5 *κ* proportion of the speech pauses of the overall signal, that is, the intensity which is not exceeded by a proportion of segments of 0.5 *κ* proportions of the speech pauses.

Determination of Further Statistical Characteristics

Figure 7:
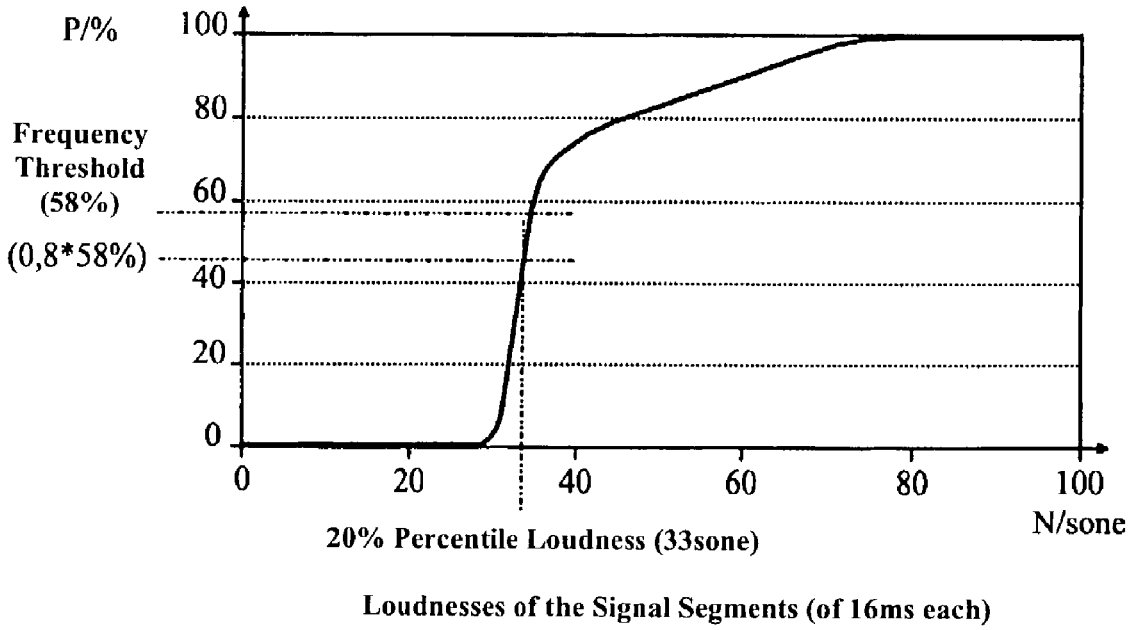
FIG. 7 shows the relative frequency distribution of FIG. 4 demonstrating determination of a percentile characteristic.

Using this method, other statistical intensity characteristics can be determined as well. In FIG. 7, it is demonstrated by the example from FIG. 4, how the intensity value which is only exceeded by 20% of the speech pause segments (20% percentile loudness) can be determined from the function.

In the given example, the intensity value is sought which is not reached by 80% of the segments during speech pauses, that is, the abscissa value is sought which applies to ordinate value P=0.58 * 0.8=0.46. Due to the low-fluctuation disturbing noise selected in the example, the value is only slightly smaller than the maximum value.

Exemplary Embodiment of the Determination of the Arithmetic Mean from the Distribution Density Function The exemplary embodiment of the method or determining the intensity of background noise presented here determines the arithmetic mean of all loudnesses of the segments below a certain frequency threshold. This frequency threshold corresponds to the proportion of speech pauses in the signal, and the calculated arithmetic mean is regarded as the mean loudness during speech pauses. In this exemplary embodiment, the distribution density function is used for that purpose.

The prerequisite is that both signals, i.e., the undisturbed source speech signal and the disturbed signal to be assessed are available completely recorded.

Initially, the proportion of speech pauses $P_z$ in this signal is determined on the basis the source speech signal using a suitable threshold.

The second step is the calculation of the desired intensity values for successive short signal segments of the speech signal to be assessed. In this exemplary embodiment, the loudnesses are calculated according to ISO532 in successive signal segments having a length of 16 ms. The distribution function is approximated by a series of single values (discrete relative frequency distribution). These single values are denoted by successive indices m. The series of single values is limited at a maximum value M (for example: $P_0 \ldots P_{200}$). During evaluation, each single value $P_m$ whose index exceeds the determined intensity X of the evaluated signal segment is increased by the numerator 1. Upon evaluation of the entire signal, all single values are divided by the number of all evaluated signal segments. Then, each single value $P_m$ contains the relative frequency of the signal segments that have a loudness which is smaller than the value of the index.

On the basis of the previously determined proportion of speech pauses $P_z$, the frequency value $P_s$ is determined which has the smallest absolute difference from $P_z$. Index S of this single value $P_s$ indicates the corresponding loudness, that is, the loudness which is not exceeded by a proportion $P_s$ of all segments. Next, to determine the arithmetic mean of the loudnesses of all segments whose loudnesses are below the predetermined frequency threshold $P_s$, the discrete frequency distribution $P_0 \ldots P_M$ has to be converted to a discrete frequency density (strip frequency) $P_0 \ldots P_{M-1}$. To this end, the differences of two successive single values are generated and stored as set of values $P_0 \ldots P_{N-1}$.

$$P_m = P_{m+1} - P_m \text{ for all } m = 0 \ldots M-1$$

Value $p_m$ the contains the relative frequency of the segments whose loudness is between m and m−1. The arithmetic mean sought corresponds to the weighted sum over the strip frequency $P_m$ up to m=S, that is, to the loudness which is not exceeded by a proportion $P_s$ of all segments:

$$\tilde{N}_{av} = \sum_{m=0}^{S} \left(m + \frac{1}{2}\right) p_m \Big/ \sum_{m=0}^{S} p_m = \sum_{m=0}^{S} \left(m + \frac{1}{2}\right) p_m / P_s$$

The correction value ½ corresponds to half the distance of two successive indices. Value $p_m$ contains the relative frequency of segments whose loudnesses are between m and m+1. Assuming uniform distribution of the loudnesses from m . . . m−1, the expected value of all loudnesses determined here is therefore m+0.5.

As described in the application case, the method yields a discrete frequency distribution with a resolution of 1 sone since index m is integral and the loudness values are directly associated with the corresponding indices. To achieve other, higher or reduced resolutions if desired, the loudness value has to be multiplied by corresponding factors prior to calculating the relative frequency distribution.

To demonstrate the measuring accuracy of the presented method, measured values for different signals and background noises are listed in Table 1. Speech signals having a length of 32 s and different proportions of speech pauses (35%, 58% and 91%) were each mixed with different noises. Initially, white noise having different speech-to-noise ratios was used as noise. Moreover, continuously spoken speech and two noises from real acoustic environments (street and office) were used.

Prior to calculating the frequency distribution, all loudness values are multiplied by a factor 2 to increase the resolution of the representation when using integral indices. This then corresponds to a loudness grading of 0.5 sone for integral indices. With the frequency distribution function being limited at $P_{200}$, it is thus possible to image loudnesses of 0 . . . 100 sone in steps of 0.5 sone. However, it should be observed that this factor is applied to all results as a divisor for correction. In the exemplary embodiment selected here, this means that the calculate arithmetic mean has to be divided by 2.

Explanations on Table 1: The speech-to-noise ratio serves only for information purposes; the basis is formed by the distance of the mean effective level during speech activity from the mean effective level of the background noise. The mean loudness value (target value) was determined in a reference measurement in which the speech pauses were manually marked and evaluated in segments of 16 ms. The calculated standard deviations refer to the reference loudnesses measured in this manner and provide information on the magnitude of the occurring fluctuations. The measured values in column 5 were determined using the method described in this exemplary embodiment.

TABLE 1

| Noise | SNR | Mean loudness (sone) target value | Standard deviation of the segment loudnesses | Mean loudness (sone) measured with the described method | Deviation (measuring error) abs./rel. |
|---|---|---|---|---|---|
| Proportion of pauses of the speech signal 91% | | | | | |
| White noise | 6 dB | 41.4 | 1.55 | 42.0 | 0.6/1.4% |
| White noise | 10 dB | 32.3 | 1.22 | 32.6 | 0.3/0.9% |
| White noise | 16 dB | 22.2 | 0.87 | 22.3 | 0.1/0.4% |
| Speech | 6 dB | 21.3 | 11.7 | 20.6 | −0.7/−3.3% |
| Speech | 10 dB | 16.5 | 9.16 | 16.2 | −0.3/−1.8% |
| Speech | 16 dB | 11.2 | 6.21 | 11.3 | 0.1/0.9% |
| Street noise | 10 dB | 26.0 | 3.22 | 26.2 | 0.2/0.8% |
| Office noise | 10 dB | 26.3 | 2.78 | 26.6 | 0.3/1.1% |
| Proportion of pauses of the speech signal: 58% | | | | | |
| White noise | 6 dB | 41.3 | 1.55 | 44.8 | 3.5/8.5% |
| White noise | 10 dB | 32.3 | 1.22 | 34.2 | 1.9/6.0% |
| White noise | 16 dB | 22.1 | 0.87 | 22.6 | 0.5/2.2% |
| Speech | 6 dB | 20.7 | 11.7 | 19.0 | −1.7/−8.2% |
| Speech | 10 dB | 16.0 | 9.16 | 15.4 | −0.6/−3.8% |
| Speech | 16 dB | 10.7 | 6.21 | 10.8 | 0.1/0.9% |
| Street noise | 10 dB | 26.1 | 3.22 | 27.0 | 0.9/3.4% |
| Office noise | 10 dB | 26.3 | 2.78 | 27.3 | 1.0/3.8% |

TABLE 1-continued

| Noise | SNR | Mean loudness (sone) target value | Standard deviation of the segment loudnesses | Mean loudness (sone) measured with the described method | Deviation (measuring error) abs./rel. |
|---|---|---|---|---|---|
| Proportion of the speech signal 35% | | | | | |
| White noise | 6 dB | 41.3 | 1.55 | 46.1 | 4.8/11.6% |
| White noise | 10 dB | 32.3 | 1.22 | 35.6 | 3.3/10.2% |
| White noise | 16 dB | 22.1 | 0.87 | 23.3 | 1.2/5.4% |
| Speech | 6 dB | 20.0 | 11.22 | 17.6 | −2.4/−12% |
| Speech | 10 dB | 15.6 | 8.7 | 15.0 | −0.6−3.8% |
| Speech | 16 dB | 10.9 | 5.93 | 11.8 | 0.9/8.3% |
| Street noise | 10 dB | 26.1 | 3.22 | 27.3 | 1.2/4.6% |
| Office noise | 10 dB | 26.3 | 2.78 | 27.9 | 1.6/6.1% |

First of all, it can be established that the measuring accuracy increases as the proportion of pauses in the signal to be assessed increases. An increase in measuring accuracy can also be established in the case of a decrease in the noise intensity or a reduced temporal fluctuation of the background noise. Starting from a typical proportion of speech pauses in a telephone communication of $P_z$>50%. the measured values achieved by the presented method are satisfactory even in the case of stronger fluctuations in the background noise (for example, speech).

Exemplary Embodiment of the Determination of the Arithmetic Mean Using A Simplified Method This particular exemplary embodiment shows an application of the described simplified method for determining the arithmetic mean, using a weighted normal distribution.

The simplified method dispenses with the calculation of the strip frequency and derives an estimate for the arithmetic mean of the loudnesses of all segments whose loudnesses are below predetermined frequency threshold $P_z$ directly from relative frequency distribution $P_m$. As described, only value k has to be defined for the estimation.

In this exemplary embodiment, the definition is done with k=1.1. The estimate then corresponds to the loudness value which is not exceeded by a proportion of 0.5 *1.1* $P_z$ of all evaluated segments. In the exemplary embodiment, this estimate of the arithmetic mean of the loudnesses corresponds to the index m of the frequency value which has the lowest absolute difference from 0.55 $P_z$. The measured values which have been obtained by this simplified method are listed in Table 2. Here too, all loudness values were multiplied by a factor 2 and the results were corrected accordingly to increase the resolution to 0.5 sone.

TABLE 2

| Noise | SNR | Mean loudness (sone) target value | Standard deviation of the segment loudnesses | Mean loudness (sone) measured with the simplified method | Deviation (measuring error) abs./rel. |
|---|---|---|---|---|---|
| Proportion of pauses of the speech signal 91% | | | | | |
| White noise | 6 dB | 41.4 | 1.55 | 41.5 | 0.1/0.2% |
| White noise | 10 dB | 32.3 | 1.22 | 32.5 | 0.2/0.6% |
| White noise | 16 dB | 22.2 | 0.87 | 22.5 | 0.3/1.3% |
| Speech | 6 dB | 21.3 | 11.7 | 20.5 | −0.8/−3.8% |
| Speech | 10 dB | 16.5 | 9.16 | 16.5 | 0.0/0.0% |

TABLE 2-continued

| Noise | SNR | Mean loudness (sone) target value | Standard deviation of the segment loudnesses | Mean loudness (sone) measured with the simplified method | Deviation (measuring error) abs./rel. |
|---|---|---|---|---|---|
| Speech | 16 dB | 11.2 | 6.21 | 11.0 | −0.2/1.8% |
| Street noise | 10 dB | 26.0 | 3.22 | 26.0 | 0.0/0.0% |
| Office noise | 10 dB | 26.3 | 2.78 | 26.5 | 0.2/0.6% |
| Proportion of pauses of the speech signal 58% | | | | | |
| White noise | 6 dB | 41.30 | 1.55 | 41.50 | 0.2/0.5% |
| White noise | 10 dB | 32.3 | 1.22 | 32.5 | 0.2/0.6% |
| White noise | 16 dB | 22.1 | 0.87 | 22.5 | 0.4/1.8% |
| Speech | 6 dB | 20.7 | 11.7 | 20.0 | −0.7/−3.4% |
| Speech | 10 dB | 16.0 | 9.16 | 16.0 | 0.0/0.0% |
| Speech | 16 dB | 10.7 | 6.21 | 11.0 | 0.3/2.8% |
| Street noise | 10 dB | 26.1 | 3.22 | 26.0 | −0.1/−0.4% |
| Office noise | 10 dB | 26.3 | 2.78 | 26.5 | 0.2/0.8% |
| Proportion of pauses of the speech signal 35% | | | | | |
| White noise | 6 dB | 41.3 | 1.55 | 41.0 | −0.3/0.7% |
| White noise | 10 dB | 32.3 | 1.22 | 32.5 | 0.2/0.6% |
| White noise | 16 dB | 22.1 | 0.87 | 22.5 | 0.4/1.8% |
| Speech | 6 dB | 20.0 | 11.22 | 19.0 | −1.0/−5% |
| Speech | 10 dB | 15.6 | 8.7 | 15.5 | −0.1/−0.6% |
| Speech | 16 dB | 10.9 | 5.93 | 11.5 | 0.6/5.5% |
| Street noise | 10 dB | 26.1 | 3.22 | 25.5 | −0.6/−1.4% |
| Office noise | 10 dB | 26.3 | 2.78 | 26.5 | 0.2/0.8% |

The simplified method not only saves computing time, but also yields measured values with a markedly higher accuracy in the evaluated examples compared to the values from Table 1. Since index m is directly used as the estimate, the accuracy of the estimation is limited to the resolution of the relative discrete frequency distribution (here: 0.5 sone).

Using the simplified measurement method described, good measured values are attained even in the case of noises with stronger fluctuation. For the selected speech-to-noise ratios of 6 dB, moreover, it can no longer be assumed that all loudnesses during speech pauses have a smaller loudness than speech segments. Nevertheless, the measured values were hardly corrupted. The simplified method described is also suitable for signals having a smaller proportion of pauses.

Exemplary Embodiment of the Determination of Percentile Loudnesses from the Relative Frequency Distribution The percentile loudness of all segments below a certain frequency threshold $P_z$, can be determined by multiplying this relative frequency $P_z$ by a value 1-percentile value (for example, 10% percentile loudness: $P_{z10\%}$=0.9* $P_z$). The integral index m of frequency value $P_m$ value which has the lowest absolute difference from $P_{S10\%}$ yields the percentile loudness value sought.

The 10% percentile loudnesses for the examples already listed in Tables 1 and 2 are given in Table 3 and compared to a manually determined reference value.

TABLE 3

| Noise | SNR | 10% percentile loudness (sone) target value | Standard deviation of the segment loudnesses | 10% percentile loudness (sone) measured over frequency distribution | Deviation (measuring error) abs./rel. |
|---|---|---|---|---|---|
| Proportion of pauses of the speech signal 91% | | | | | |
| White noise | 6 dB | 42.5 | 1.55 | 43.0 | 0.5/1.2% |
| White noise | 10 dB | 33.0 | 1.22 | 34.0 | 1.0/3.0% |
| White noise | 16 dB | 22.5 | 0.87 | 23.5 | 1.0/4.4% |
| Speech | 6 dB | 37.0 | 11.7 | 34.5 | −2.5/−6.8% |
| Speech | 10 dB | 28.5 | 9.16 | 27.5 | −1.0/−3.5% |
| Speech | 16 dB | 19.0 | 6.21 | 19.5 | 0.5/2.6% |
| Street noise | 10 dB | 29.5 | 3.22 | 30.0 | 0.5/1.7% |
| Office noise | 10 dB | 29.0 | 2.78 | 29.5 | 0.5/1.7% |
| Proportion of pauses of the speech signal 58% | | | | | |
| White noise | 6 dB | 42.5 | 1.55 | 42.5 | 0.0/0.0% |
| White noise | 10 dB | 33.0 | 1.22 | 33.5 | 0.5/1.5% |
| White noise | 16 dB | 22.5 | 0.87 | 23.0 | 0.5/2.2% |
| Speech | 6 dB | 36.0 | 11.7 | 29.0 | −7.0/−19% |
| Speech | 10 dB | 28.5 | 9.16 | 24.5 | −4.0/−14% |
| Speech | 16 dB | 19.0 | 6.21 | 18.0 | −1.0/−5.3% |
| Street noise | 10 dB | 30.0 | 3.22 | 29.0 | −1.0/−3.3% |
| Office noise | 10 dB | 29.0 | 2.78 | 28.5 | −0.5/−1.6% |
| Proportion of pauses of the speech signal 35% | | | | | |
| White noise | 6 dB | 42.5 | 1.55 | 42.5 | 0.0/0.0% |
| White noise | 10 dB | 33.0 | 1.22 | 33.5 | 0.5/1.5% |
| White noise | 16 dB | 22.5 | 0.87 | 23.5 | 1.0/2.2% |
| Speech | 6 dB | 35.5 | 11.22 | 24.0 | −11.5/−33% |
| Speech | 10 dB | 27.5 | 8.7 | 21.0 | −6.5/−24% |
| Speech | 16 dB | 19.0 | 5.93 | 17.5 | −1.5/−7.9% |
| Street noise | 10 dB | 29.5 | 3.22 | 28.0 | −1.5/−4.8% |
| Office noise | 10 dB | 29.0 | 2.78 | 28.5 | −0.5/−1.6% |

The measured values show a good estimation of the percentile loudness for background noises with weak fluctuation. For speech, only inadequate accuracies are attained, above all in the case of a small proportion of pauses. Only in the case of higher speech-to-noise ratios, the results are serviceable to good.

What is claimed is:

1. A method for determining speech quality using intensity characteristics of background noise during speech pauses of speech signals, the method comprising:

providing an undisturbed source speech signal and a disturbed speech signal so as to define a frequency threshold;

determining a proportion of speech pauses in the undisturbed source speech signal so as to define a frequency threshold;

dividing the disturbed speech signal into short successive signal elements;

determining an intensity value for each of the signal elements;

forming a cumulative relative frequency distribution from the determined intensity values of the signal elements;

determining an intensity threshold value corresponding to the defined frequency threshold using the cumulative relative frequency distribution; and determining at least one intensity characteristic of the background noise during the speech pauses using a region of the cumulative relative frequency distribution below the intensity threshold value so as to determine the speech quality.

2. The method as recited in claim 1 further comprising assessing as belonging to the speech pauses all signal segments having an intensity values smaller than the intensity threshold value.

3. The method as recited in claim 1 wherein the cumulative relative frequency distribution of the signal segments in the region below the intensity threshold value represents a frequency distribution of the intensity values during the speech pauses.

4. The method as recited in claim 1 wherein:

the at least one intensity characteristic includes an arithmetic mean of the intensity values during the speech pauses, and the arithmetic mean is determined by deriving a distribution density from the cumulative relative frequency distribution and subsequently integrating over the distribution density in the region below the intensity threshold value.

5. The method as recited in claim 1 wherein:

the at least one intensity characteristic includes an arithmetic mean of the intensity values during the speech pauses, and the arithmetic mean is determined by approximating an intensity distribution in the region below the intensity threshold value by a normal distribution weighted by a weighting factor, and multiplying the intensity threshold value by 0.5 and the weighting factor.

6. The method as recited in claim 1 wherein the at least one intensity characteristic includes a percentile characteristic, the percentile characteristic being determined by:

subtracting a predetermined percentile value from 100 percent so as to determine a difference;

multiplying the difference by the frequency threshold value so as to determine a resulting frequency value; and determining an intensity value corresponding to the resulting frequency value as the percentile characteristic using the cumulative relative frequency distribution.

7. A method for determining speech quality by assessing background noise during speech pauses of speech signals, the method comprising:

providing a recorded undisturbed source speech signal and a recorded disturbed speech signal;

determining a proportion of speech pauses based on the source speech signal to define a frequency threshold;

dividing the disturbed speech signal into a series of successive signal segments;

calculating a respective loudness for each of the successive signal segments using a discrete relative frequency distribution;

determining a frequency value which has the smallest absolute difference from the frequency threshold;

calculating an arithmetic mean of the loudness of all of the signal segments having a respective loudness below the frequency value by taking a weighted sum; and determining a correction value equal to half a distance of two successive indices of the signal segments so as to determine the speech quality.

8. The method as recited in claim 7, wherein the calculating the arithmetic mean further comprises:

calculating an estimate for the arithmetic mean of the loudness of all segments having a respective loudness below the frequency threshold directly from a relative frequency distribution.

9. A method for determining speech quality by assessing background noise during speech pauses of speech signals, the method comprising:

providing a recorded undisturbed source speech signal and a recorded disturbed speech signal;

determining a proportion of speech pauses based on the source speech signal to define a frequency threshold;

dividing the disturbed speech signal into a series of successive signal segments; and determining a percentile loudness of all signal segments by multiplying a relative frequency by a value equal to 1 minus a predetermined percentile value so as to determine the speech quality.

* * * * *

UNITED STATES PATENT AND TRADEMARK OFFICE

CERTIFICATE OF CORRECTION

PATENT NO. : 7,277,847 B2
APPLICATION NO. : 10/311487
DATED : October 2, 2007
INVENTOR(S) : Jens Berger It is certified that error appears in the above-identified patent and that said Letters Patent is hereby corrected as shown below:

On the title page Item [56]
For Foreign Priority Data:

Please insert --DE 10120168.0 - April 18, 2001--

Signed and Sealed this

Eleventh Day of December, 2007

JON W. DUDAS
*Director of the United States Patent and Trademark Office*